US008456414B2

(12) United States Patent
Lin et al.

(10) Patent No.: US 8,456,414 B2
(45) Date of Patent: Jun. 4, 2013

(54) GAMMA ADJUSTMENT WITH ERROR DIFFUSION FOR ELECTROPHORETIC DISPLAYS

(75) Inventors: Craig Lin, San Jose, CA (US); Thomas L. Credelle, Morgan Hill, CA (US)

(73) Assignee: SiPix Imaging, Inc., Fremont, CA (US)

( * ) Notice: Subject to any disclaimer, the term of this patent is extended or adjusted under 35 U.S.C. 154(b) by 999 days.

(21) Appl. No.: 12/498,904

(22) Filed: Jul. 7, 2009

(65) Prior Publication Data

US 2010/0027073 A1 Feb. 4, 2010

Related U.S. Application Data

(60) Provisional application No. 61/085,543, filed on Aug. 1, 2008.

(51) Int. Cl.
*G09G 3/34* (2006.01)
*G09G 5/10* (2006.01)

(52) U.S. Cl.
USPC ..... 345/107; 345/690

(58) Field of Classification Search
USPC ..... 345/87–104, 107, 204–215, 690–699
See application file for complete search history.

(56) References Cited

U.S. PATENT DOCUMENTS 3,612,758 A 10/1971 Evans et al.
4,972,099 A 11/1990 Amano et al.
5,272,477 A 12/1993 Tashima et al.
5,930,026 A 7/1999 Jacobson et al.
5,961,804 A 10/1999 Jacobson et al.
6,019,284 A 2/2000 Freeman et al.
6,657,612 B2 12/2003 Machida et al.
6,774,883 B1 8/2004 Muhlemann
6,885,495 B2 4/2005 Liang et al.
6,902,115 B2 6/2005 Graf et al.
6,930,818 B1 8/2005 Liang et al.
6,932,269 B2 8/2005 Sueyoshi et al.
6,950,220 B2 9/2005 Abramson et al.
7,005,468 B2 2/2006 Zang et al.
7,046,228 B2 5/2006 Liang et al.

(Continued)

FOREIGN PATENT DOCUMENTS

JP 03282691 12/1991
JP 2002014654 1/2002

(Continued)

OTHER PUBLICATIONS

Korean Patent Office, "International Search Report & Written Opinion", dated Dec. 7, 2010, application No. PCT/US2010/033906, 9 pages.

(Continued)

*Primary Examiner* — Alexander Eisen
*Assistant Examiner* — Patrick F Marinelli
(74) *Attorney, Agent, or Firm* — Perkins Coie LLP.

(57) ABSTRACT

Embodiments are directed to image processing methods to improve display quality while using a limited number of pulses and to correct the error between the reflectance and the desired gamma. The complexity of the hardware used for driving a display device may then be reduced to minimum. In addition, in various embodiments the method can also be used to compensate for the change of an optical response curve due to batch variation, temperature change, photo-exposure or aging of the display device.

19 Claims, 9 Drawing Sheets

U.S. PATENT DOCUMENTS

| | | | | |
|---|---|---|---|---|
| 7,177,066 | B2 | 2/2007 | Chung et al. | |
| 7,573,472 | B2 * | 8/2009 | Aoki et al. | 345/208 |
| 7,626,444 | B2 | 12/2009 | Clewett et al. | |
| 8,130,192 | B2 * | 3/2012 | Feng | 345/107 |
| 8,243,013 | B1 * | 8/2012 | Sprague et al. | 345/107 |
| 2002/0021483 | A1 | 2/2002 | Katase | |
| 2003/0011868 | A1 | 1/2003 | Zehner et al. | |
| 2003/0067666 | A1 | 4/2003 | Kawai | |
| 2003/0227451 | A1 | 12/2003 | Chang | |
| 2004/0112966 | A1 | 6/2004 | Pangaud | |
| 2004/0120024 | A1 | 6/2004 | Chen et al. | |
| 2004/0219306 | A1 | 11/2004 | Wang et al. | |
| 2005/0162377 | A1 | 7/2005 | Zhou et al. | |
| 2005/0163940 | A1 | 7/2005 | Liang et al. | |
| 2006/0007067 | A1 | 1/2006 | Baek | |
| 2006/0049263 | A1 | 3/2006 | Ou et al. | |
| 2006/0197738 | A1 * | 9/2006 | Kawai | 345/107 |
| 2006/0209055 | A1 | 9/2006 | Wakita | |
| 2006/0238488 | A1 | 10/2006 | Nihei et al. | |
| 2007/0091117 | A1 | 4/2007 | Zhou et al. | |
| 2008/0259015 | A1 * | 10/2008 | Nose | 345/89 |
| 2010/0283804 | A1 | 11/2010 | Sprague et al. | |
| 2010/0295880 | A1 * | 11/2010 | Sprague et al. | 345/690 |
| 2012/0038687 | A1 * | 2/2012 | Lin et al. | 345/690 |

FOREIGN PATENT DOCUMENTS

| | | | |
|---|---|---|---|
| JP | 2006-243478 | A1 | 9/2006 |
| KR | 2004-0036313 | A1 | 4/2004 |
| KR | 2007-0033230 | A1 | 3/2007 |
| KR | 1020090129191 | A | 12/2009 |
| WO | WO 01/67170 | | 9/2001 |
| WO | 2010/014359 | | 2/2010 |

OTHER PUBLICATIONS

Current Claims for Korean application No. PCT/US2010/033906, 1 page.

Korean Intellectual Property Office, International Search Report, Feb. 18, 2010, in international application PCT/US2009/049817, published by WIPO, Geneva, Switzerland.

Korean Intellectual Property Office, Written Opinion, Feb. 18, 2010, in international application PCT/US2009/049817, published by WIPO, Geneva, Switzerland.

U.S. Appl. No. 12/115,512, filed May 5, 2011, Office Action, May 10, 2011.

U.S. Appl. No. 11/972,150, filed Jan. 10, 2008, Notice of Allowance, Jun. 2, 2011.

U.S. Appl. No. 11/636,407, filed Dec. 7, 2006, Final Office Action, Jun. 3, 2011.

Allen, K. (Oct. 2003). Electrophoretics Fulfilled. Emerging Displays Review: Emerging Display Technologies, Monthly Report, 9-14.

Bardsley, J.N. et al. (Nov. 2004) Microcup™ Electrophoretic Displays. USDC Flexible Display Report, 3.1.2. pp. 3-12-3-16.

Chaug, Y.S. et al. (Apr. 2004). Roll-to-Roll Processes for the Manufacturing of Patterned Conductive Electrodes on Flexible Substrates. Mat. Res. Soc. Symp. Proc., vol. 814, I9.6.1.

Chen, S.M. (Jul. 2003) The Applications for the Revolutionary Electronic Paper Technology. OPTO News & Letters, 102, 37-41. (in Chinese, English abstract).

Chen, S.M. (May 2003) tThe New Application and the Dynamics of Companies. Tri. 1-10. (in Chinese, English abstract).

Chung, J. et al. (Dec. 2003). Microcup® Electrophoretic Displays, Grayscale and Color Rendition. IDW, AMD2/EP1-2, 243-246.

Ho, A. Embedding e-Paper in Smart Cards, Pricing Labels & Indicators. Presentation conducted at Smart Paper Conference Nov. 15-16, 2006, Atlanta, GA.

Ho, C. et al. (Dec. 2003). Microcup® Electronic Paper by Roll-to-Roll Manufacturing Processes. Presentation conducted at FEG, Nei-Li, Taiwan, 36 pages.

Ho, C. (Feb. 1, 2005) Microcupt® Electronic Paper Device and Applicaiton. Presentation conducted at USDC 4th Annual Flexible Display Conference 2005, 36 pages.

Hopper, et al. (1979) An Electrophoretic Display, Its Properties, Model and Addressing. IEEE Trans. Electr. Dev., Ed 26, No. 8, pp. 1148-1152.

Hou, J. et al. (May 2004). Reliability and Performance of Flexible Electrophoretic Displays by Roll-to-Roll Manufacturing Processes. SID Digest, 32.3, 1066-1069.

Howard, R. (Feb. 2004) Better Displays with Organic Films. Scientific American, pp. 76-81.

Kishi, et al., Development of In-plane EPD, SID 2000 Digest, pp. 24-27.

Lee, H. et al. (Jun. 2003) SiPix Microcup® Electronic Paper—An Introduction. Advanced Display, Issue 37, 4-9 (in Chinese, English abstract).

Liang, R.C. (Feb. 2003) Microcupe® Electrophoretic and Liquid Crystal Displays by Roll-to-Roll Manufacturing Processes. Presentation conducted at the Flexible Microelectronics & Displays Conference of U.S. Display Consortium, Phoenix, Arizona, USA, 18pages.

Liang, R.C. (Apr. 2004). Microcup Electronic Paper by Roll-to-Roll Manufacturing Process. Presentation at the Flexible Displays & Electronics 2004 of Intertech, San Francisco, California, USA, 26 pages.

Liang, R.C. (Oct. 2004) Flexible and Roll-able Displays/Electronic Paper—A Technology Overview. Paper presented at the METS 2004 Conference in Taipei, Taiwan, 27 pages.

Liang, R. et al. (2003). Microcup® Active and Passive Matrix Electrophoretic Displays by a Roll-to-Roll Manufacturing Processes. SID Digest, 20.1, 4 pages.

Liang, R. et al. (Dec. 2002) Microcup Electrophoretic Displays by Roll-to-Roll Manufacturing Processes. IDW , EP2-2, 1337-1340.

Liang, R. et al. (Feb. 2003). Passive Matrix Microcup® Electrophoretic Displays. Paper presented at the IDMC, Taipei, Taiwan, 4 pages.

Liang, R. et al. (2003). Microcup® displays : Electronic Paper by Roll-to-Roll Manufacturing Processes. Journal of the SID, 11(4), 621-628.

Liang, R. et al. (Jun./Jul. 2004) <<Format Flexible Microcup® Electronic Paper by Roll-to-Roll Manufacturing Process>>, Presentation conducted at the 14th FPD Manufacturing Technology Expo & Conference, 44 pages.

Liang, R. et al. (Feb. 2003. Microcup® LCD, A New Type of Dispersed LCD by a Roll-to-Roll Manufacturing Process. Paper presented at the IDMC, Taipei, Taiwan, 4 pages.

Liang, R. et al., Nikkei Microdevices. (Dec. 2002) Newly-Developed Color Electronic Paper Promises—Unbeatable Production Efficiency. Nikkei Microdevices, p. 3. (in Japanese, with English translation) 4 pages.

Swanson, et al., High Performance EPDs, SID 2000, pp. 29-31.

Wang, X. et al. (Feb. 2004). Mirocup® Electronic Paper and the Converting Processes. ASID, 10.1.2-26, 396-399, Nanjing, China.

Wang, X. et al. (Jun. 2004) Microcup® Electronic Paper and the Converting Processes. Advanced Display, Issue 43, 48-51 (in Chinese, English abstract).

Wang, X. et al. (Feb. 2006) Inkjet Fabrication of Multi-Color Microcup® Electrophorectic Display. The Flexible Microelectronics & Displays Conference of U.S. Display Consortium, 11 pages.

Wang, X. et al. (Jun. 2006) Roll-to-Roll Manufacturing Process for Full Color Electrophoretic film. SID 2006 Digest, pp. 1587-1589.

Zang, H. (Feb. 2004). Microcup Electronic Paper. Presentation conducted at the Displays & Microelectronics Conference of U.S. Display Consortium, Phoenix, Arizona, USA, 14 pages.

Zang, H. (Oct. 2003). Microcup® Electronic Paper by Roll-to-Roll Manufacturing Processes. Presentation conducted at the Advisory Board Meeting, Bowling Green State University, Ohio, USA, 18 pages.

Zang, H. et al. (Feb. 2005) Flexible Microcup® EPD by RTR Process. Presentation conducted at 2nd Annual Paper-Like Displays Conference, Feb. 9-11, 2005, St. Pete Beach, Florida, 26 pages.

Zang, H. et al. (2003) Microcup Electronic Paper by Roll-to-Roll Manufacturing Processes. The Spectrum, 16(2), 16-21.

Zang, H. et al. (Jan. 2004). Threshold and Grayscale Stability of Microcup® Electronic Paper. Proceeding of SPIE-IS&T Electronic Imaging, SPIE vol. 5289, 102-108.

Zang, H. et al. (May 2006) Monochrome and Area Color Microcup® EPDs by Roll-to-Roll Manufacturing Processes. ICIS ' 06 International Congress of Imaging Science Final Program and Proceedings, pp. 362-365.

* cited by examiner

| | | | |
|---|---|---|---|
| A (70) | B (100) | C (60) | D (65) |
| E (80) | F (60) | G (45) | H (75) |

| | | | |
|---|---|---|---|
| A (**4**) | B (107) | C (60) | D (65) |
| E (83.5) | F (63.5) | G (45) | H (75) |

| | | | |
|---|---|---|---|
| A (**4**) | B (**7**) | C (64) | D (65) |
| E (83.5) | F (65.5) | G (47) | H (75) |

| | | | |
|---|---|---|---|
| A (**4**) | B (**7**) | C (**4**) | D (69) |
| E (83.5) | F (65.5) | G (49) | H (77) |

Figure 7

GAMMA ADJUSTMENT WITH ERROR DIFFUSION FOR ELECTROPHORETIC DISPLAYS

BENEFIT CLAIM

This application claims the benefit under 35 U.S.C. 119 of prior provisional application 61/085,543, filed Aug. 1, 2008, the entire contents of which are hereby incorporated by reference for all purposes as if fully set forth herein.

BACKGROUND OF THE DISCLOSURE

The grey scale of an electrophoretic display device is usually generated by applying a series of discrete pulses to the display media. The electrophoretic media, however, is not linear with the number of pulses. The optical response curve is in fact quite steep in the middle of the grey zone and less steep near off and on states. Therefore minor changes in driving time or voltage in that middle grey zone may cause a significant change in reflectance. Also, since there are a limited number of pulses between off and on, it is often difficult to obtain the desired reflectance. This can lead to undesirable non-uniformities and a poor match to a curve of target reflectance vs. input level, often referred to as a "gamma" curve.

In order to better match the gamma curve with driving characteristics of an electrophoretic display, the bandwidth of the pulse-width modulation could be increased so that there are more steps available between off and on. By having shorter pulse widths, the reflectance can be controlled more precisely. However, this approach has the disadvantage of requiring a complex hardware platform (especially for the active matrix display devices) with higher costs.

SUMMARY OF THE DISCLOSURE

In an embodiment, a method utilizes image processing to improve display quality while using a limited number of pulses and to correct the error between the reflectance and the desired gamma. The complexity of the hardware used for driving a display device may then be reduced to minimum. In addition, in various embodiments the method can also be used to compensate for the change of an optical response curve due to batch variation, temperature change, photo-exposure or aging of the display device.

In an embodiment, a method of image processing for an electrophoretic display comprises (i) inputting a plurality of image data values and a plurality of true grey level values into an image processor; (ii) performing error diffusion using the image data values and the true grey level values as input, resulting in creating a plurality of output data values comprising dithered grey level values; and (iii) outputting the output data values to an electrophoretic display device.

In an embodiment, the method further comprises determining the plurality of true grey level values by (a) selecting an optical response curve; (b) selecting integer pulse numbers; (c) identifying a true reflectance level value for each integer pulse number from the optical response curve; and (d) determining the true grey level values from their corresponding true reflectance level values.

In an embodiment, the method further comprises determining the plurality of true grey level values by (a) selecting integer pulse numbers; (b) capturing a true reflectance level value for each integer pulse number by an optical sensor; and (c) determining the true grey level values from their corresponding true reflectance level values.

In an embodiment, the method further comprises determining the plurality of true grey level values by (a) selecting an optical response curve; (b) selecting integer pulse numbers; (c) capturing a true reflectance level value for each integer pulse number by an optical sensor; and (d) determining the true grey level values from their corresponding true reflectance level values.

In an embodiment, the true grey levels are pre-calculated.

In an embodiment, a method of image processing for an electrophoretic display comprises (a) selecting an optical response curve; (b) selecting integer pulse numbers; (c) identifying the true reflectance level for each integer pulse number from the optical response curve; (d) calculating the true grey level for each true reflectance level; (e) inputting image data and the true grey levels into an image processor; (f) performing error diffusion; and (g) outputting image data with desired number of grey levels. In an embodiment, in step (b) the integer pulse numbers are selected to correspond to closest reflectance levels of a gamma curve. In an embodiment, in step (b) the integer pulse numbers are arbitrarily selected. In an embodiment, in step (d) the true grey level is calculated as True Grey Level=(Total Number of Grey Levels−1)×(Normalized True Reflectance)$^{1/\gamma}$ wherein $\gamma$ represents a desired reflectance compared to an input level characteristic. In an embodiment, the true grey levels in step (e) are in an 8 bit data format and the grey levels in step (g) are in a 4 bit format.

In an embodiment, the optical response curve is selected depending on environmental conditions.

In an embodiment, the optical response curve is selected depending on an age of an electrophoretic display.

In various embodiments, the gamma curve is a gamma 1.8 curve or a gamma 2.2 curve.

In an embodiment, the error diffusion is performed by a two dimensional error diffusion method.

In an embodiment, a display driver circuit comprises a first memory unit configured to receive and store a plurality of image data; error diffusion logic coupled to the first memory unit and configured to perform error diffusion using the image data values and the true grey level values as input and to generate and store a plurality of output data values comprising dithered grey level values; a display driver configured to couple to an electrophoretic display and to drive the electrophoretic display using the output data values.

In an embodiment, the circuit further comprises a second memory unit configured to store optical response curve data, wherein the error diffusion logic is configured to determine the plurality of true grey level values by reading the optical response curve data, selecting integer pulse numbers, identifying a true reflectance level value for each integer pulse number from the optical response curve data, and determining the true grey level values from their corresponding true reflectance level values. The optical response curve data may represent reflectance versus number of pulses.

In an embodiment, the error diffusion logic is configured to couple to an optical sensor, to determine the plurality of true grey level values by selecting integer pulse numbers, to receive a true reflectance level value for each integer pulse number from the optical sensor, and to determine the true grey level values from their corresponding true reflectance level values.

In an embodiment, the circuit further comprises a second memory unit configured to store optical response curve data, wherein the error diffusion logic is configured to determine the plurality of true grey level values by selecting an optical response curve, to select integer pulse numbers, to receive a true reflectance level value for each integer pulse number by an optical sensor, and to determine the true grey level values from their corresponding true reflectance level values. The optical response curve may represent reflectance versus number of pulses.

In an embodiment, a data display system comprises an electrophoretic display; a first memory unit configured to receive and store a plurality of image data values; error diffusion logic coupled to the first memory unit and configured to perform error diffusion using the image data values and the true grey level values as input and to generate and store a plurality of output data values comprising dithered grey level values; a second memory unit coupled to the error diffusion logic and configured to store optical response curve data, wherein the error diffusion logic is configured to determine the plurality of true grey level values by reading the optical response curve data, selecting integer pulse numbers, identifying a true reflectance level value for each integer pulse number from the optical response curve data, and determining the true grey level values from their corresponding true reflectance level values; a display driver coupled to the electrophoretic display and configured to drive the electrophoretic display using the output data values. The optical response data may represent reflectance versus number of pulses.

In an embodiment, the error diffusion logic is configured to couple to an optical sensor, to determine the plurality of true grey level values by selecting integer pulse numbers, to receive a true reflectance level value for each integer pulse number from the optical sensor, and to determine the true grey level values from their corresponding true reflectance level values.

BRIEF DISCUSSION OF THE DRAWINGS

Figure 4:
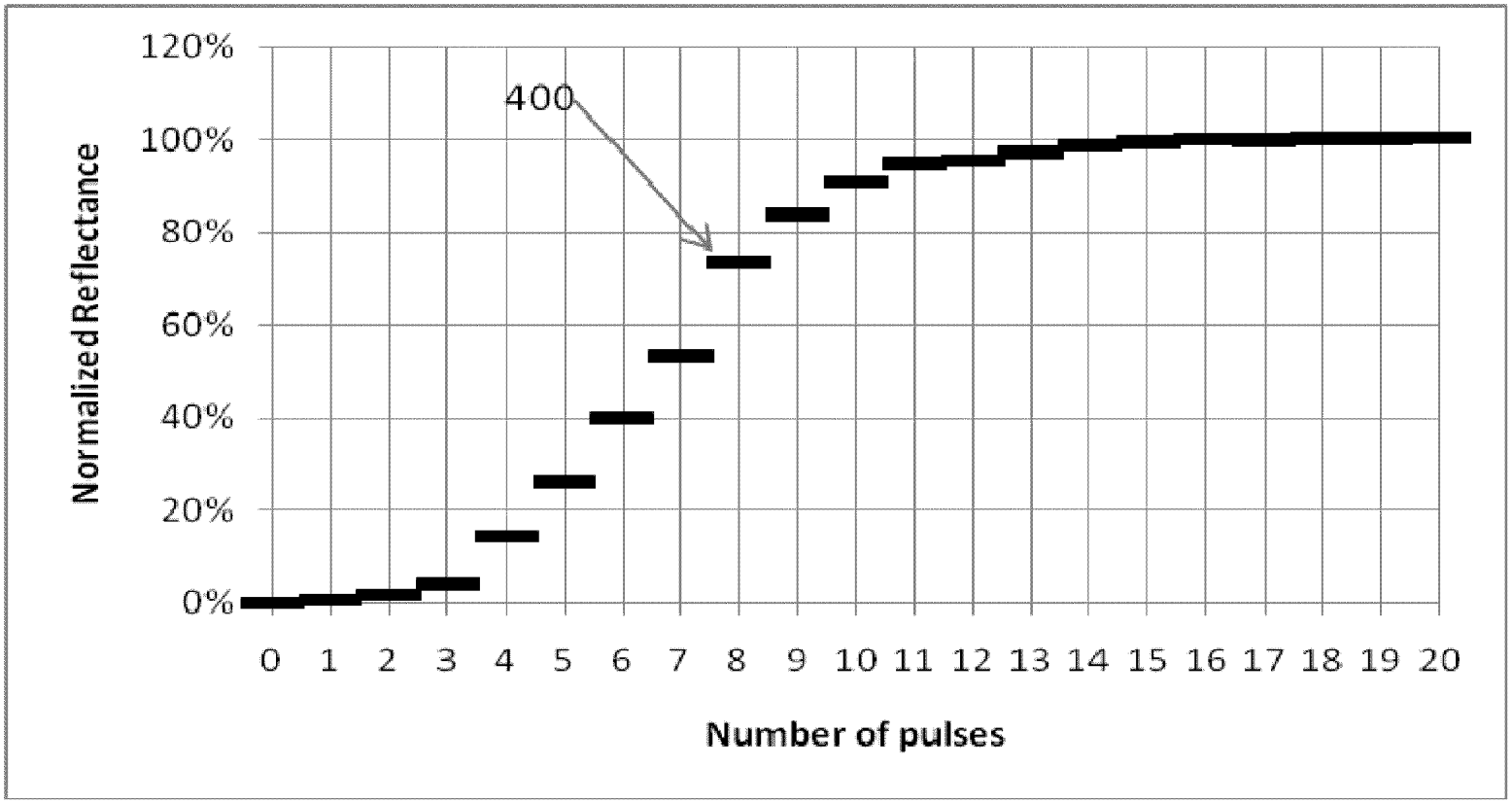
FIG. 4 is FIG. 3 re-plotted with the reflectance data normalized.
Figure 5:
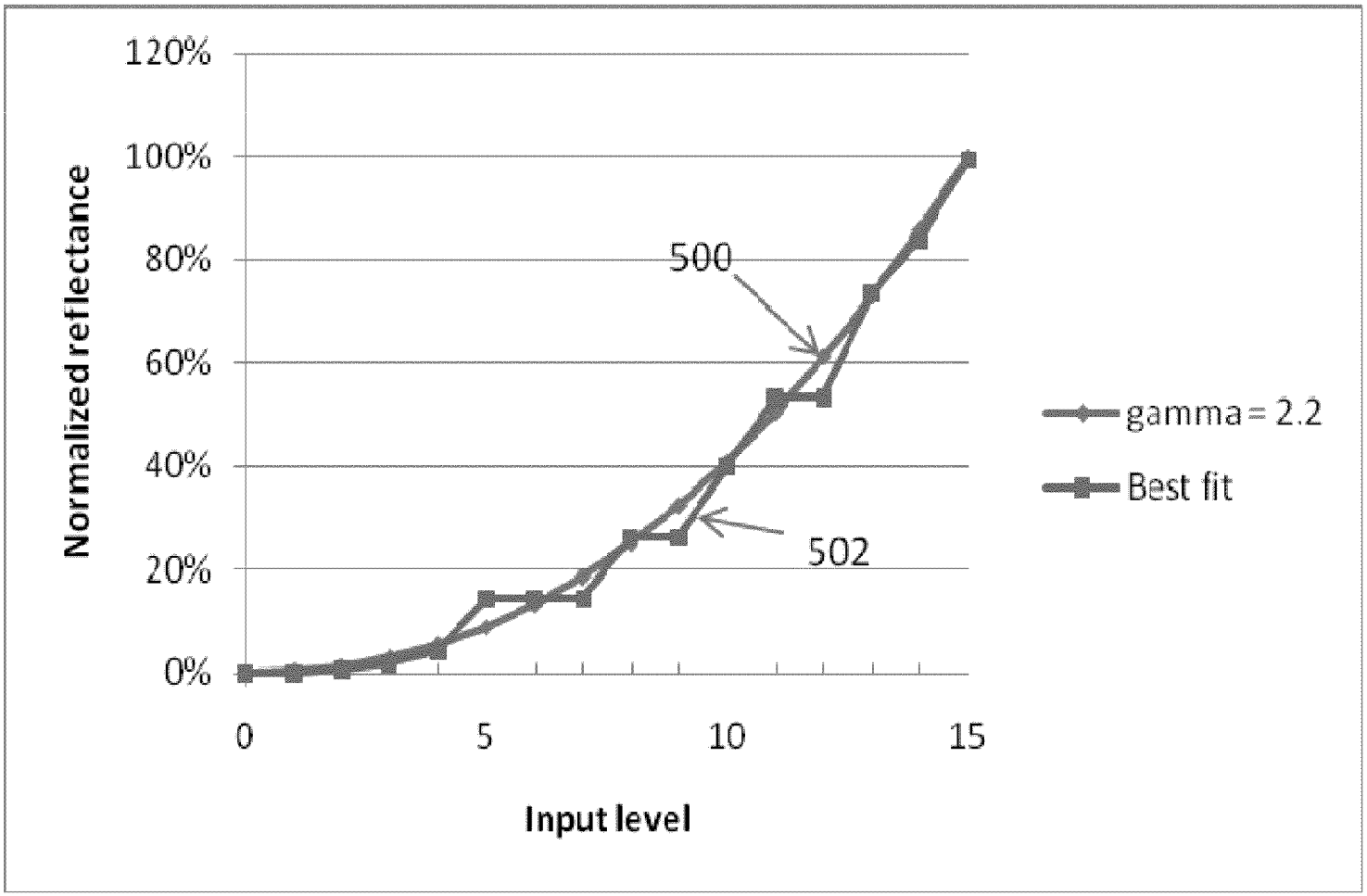
Figure 6:
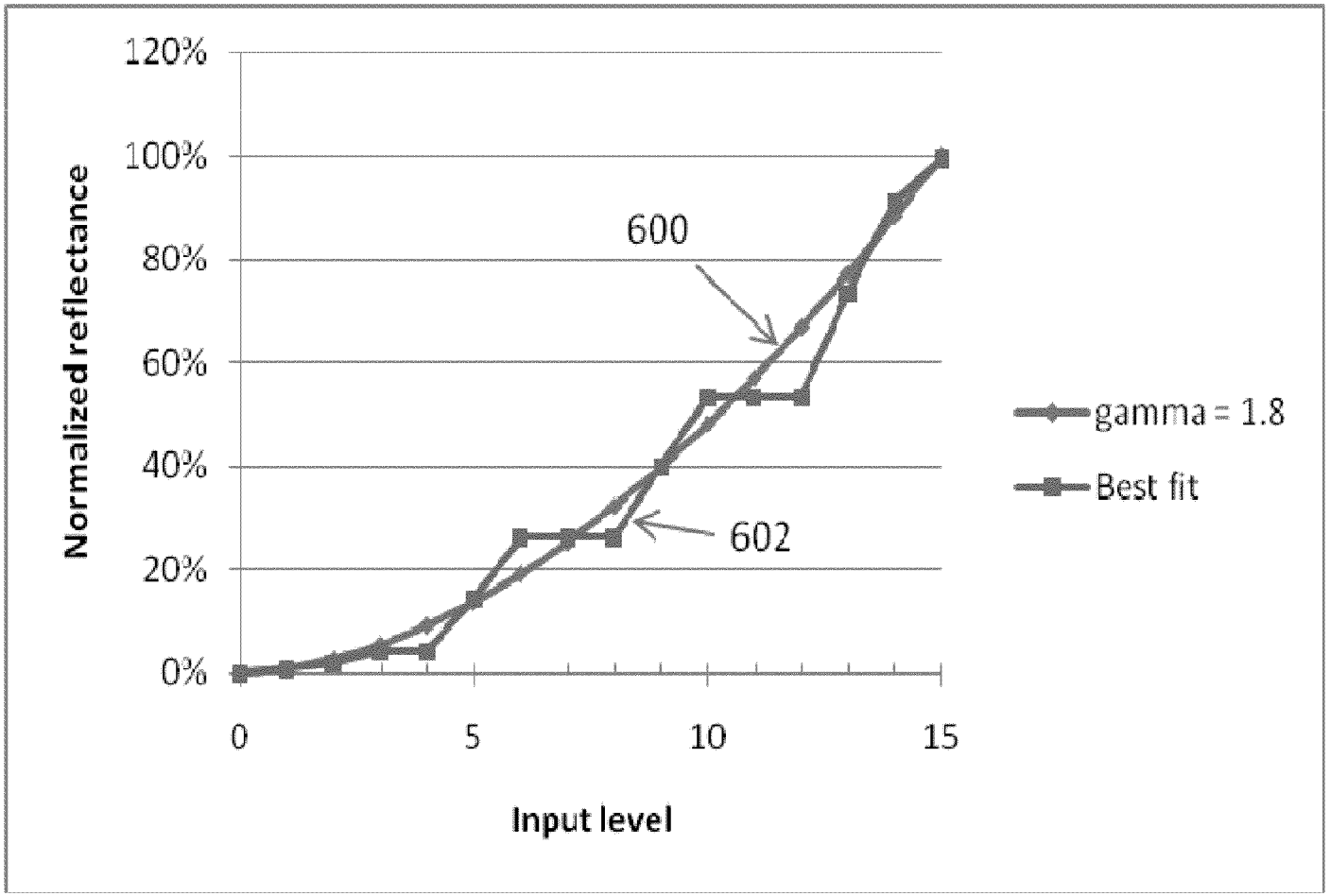

FIGS. 5 and 6 show the best possible fit to a gamma 2.2 and 1.8 respectively using the data of FIG. 4.

FIG. 7 is an example of error diffusion.

Figure 8:
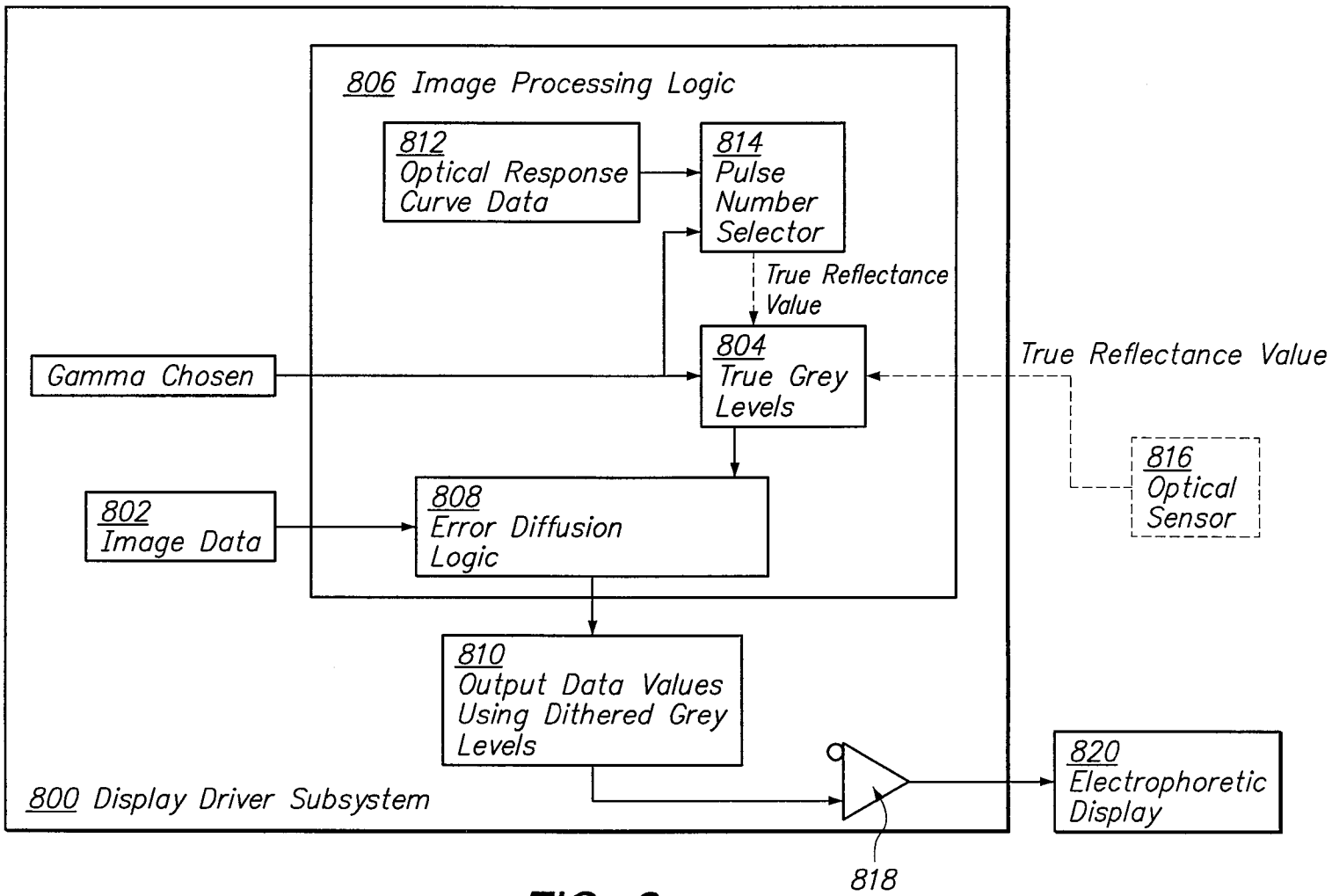

FIG. 8 is a block diagram of a display driver subsystem that may be used to implement the techniques herein.

Figure 9:
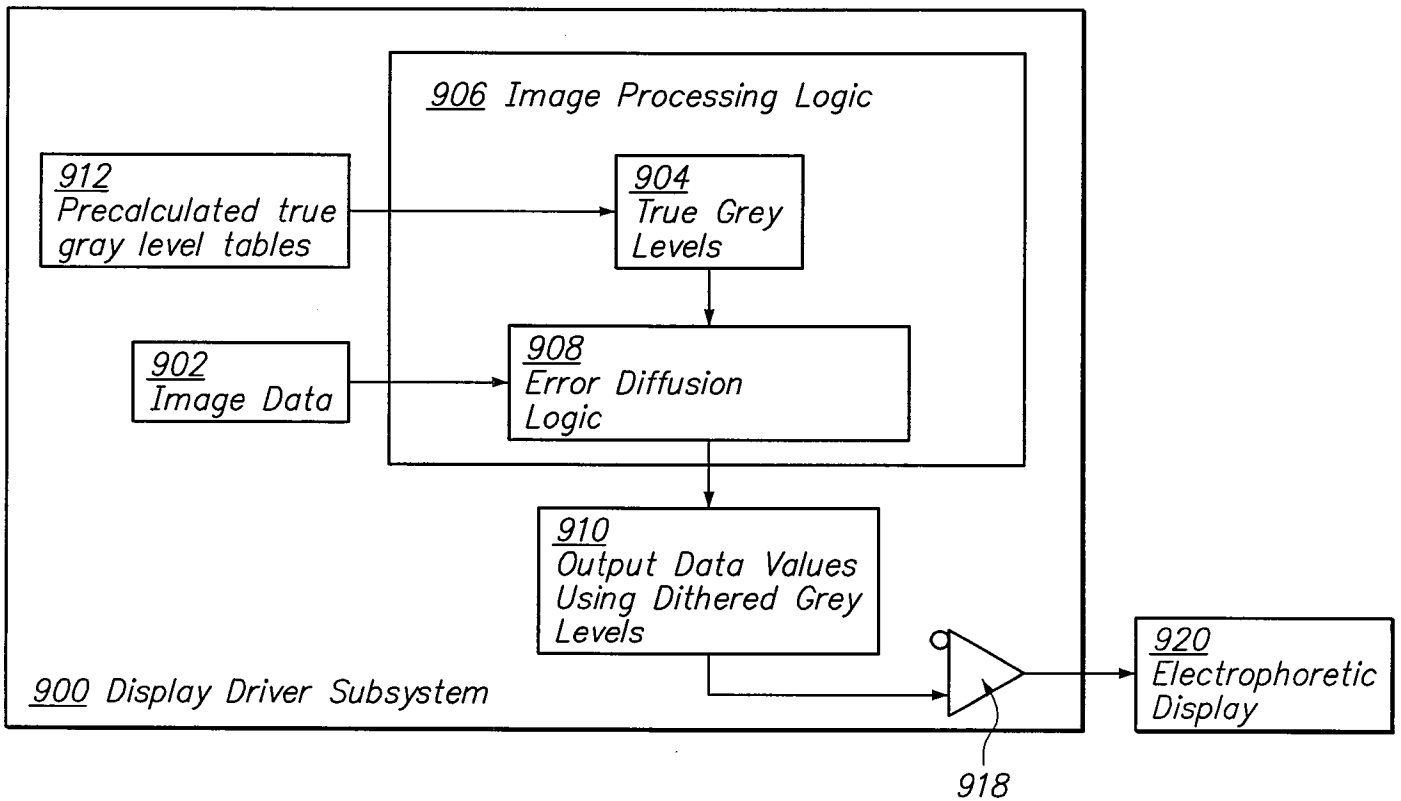

FIG. 9 is a block diagram of an alternate display driver subsystem that may be used to implement the techniques herein.

DETAILED DESCRIPTION

The level of reflectance is not in a linear relationship with the grey scale input to the display device. In fact, in order to match the human visual system (HVS), the level of reflectance should be proportional to the grey level raised to a certain power. The numerical value of the exponent of that power function is known as "gamma".

Figure 1:
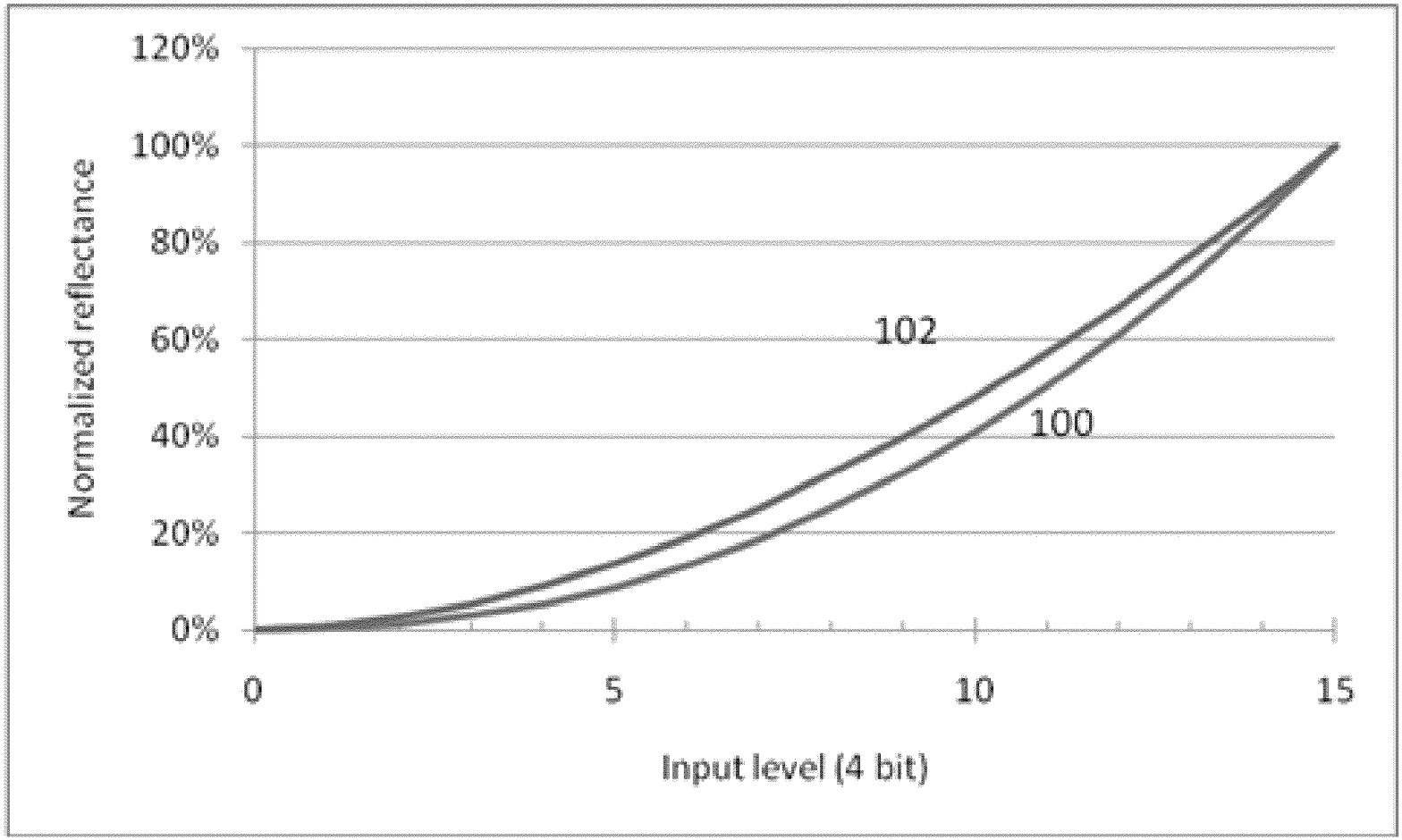
FIG. 1 illustrates typical gamma 1.8 and 2.2 curves.

FIG. 1 illustrates a first curve 100 having gamma 2.2, which is a good match to the HVS, and a second curve 102 having gamma 1.8, which has higher brightness in the middle gray zone. The X axis and Y axis, in FIG. 1, represent the grey level and the reflectance level, respectively. On the X axis, there are 16 grey levels (0-15) whereas on the Y axis, the reflectance level is expressed as from 0% to 100%. Based on the gamma curve, each grey level has a corresponding percentage value of reflectance. Most displays such as LCD, Plasma, OLED, CRT, and the like are adjusted to have a gamma of 2.2.

Figure 2:
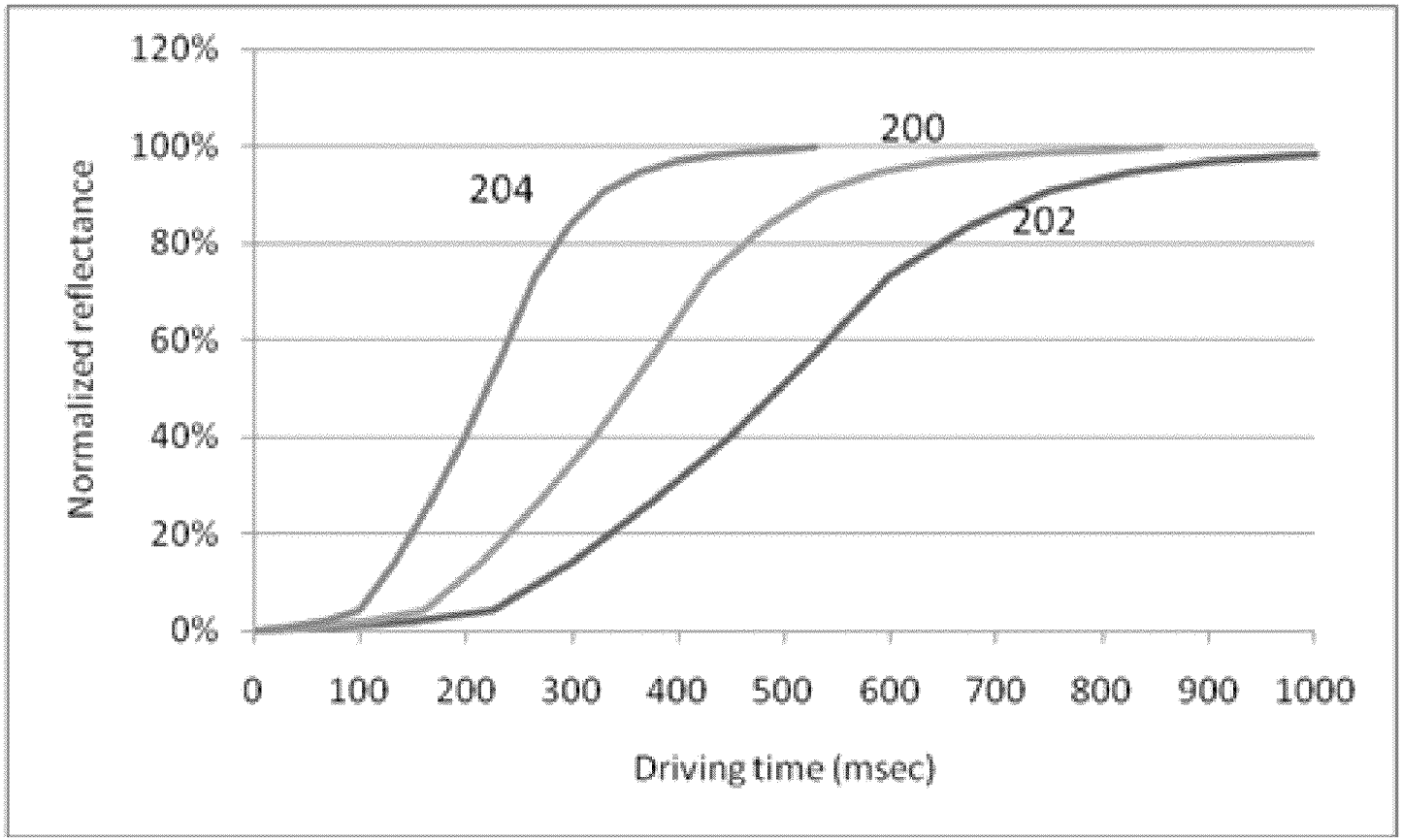
FIG. 2 is an optical response curve of an electrophoretic display.

FIG. 2 is an optical response curve of an electrophoretic display. The optical response curve 200 is shown as a function of driving time in milliseconds (msec). The optical response curve may vary from device to device, and may also vary with the same device because of, for example, photo-exposure, temperature variation or aging of the device. Curves 202 and 204 are examples of different optical response curves as a function of display temperature; for example, curve 204 is for an elevated temperature and curve 202 is for a reduced temperature. By comparing FIGS. 1 and 2, it is clear that there is not a good match between the desired gamma and the actual performance of the electrophoretic display.

Figure 3:
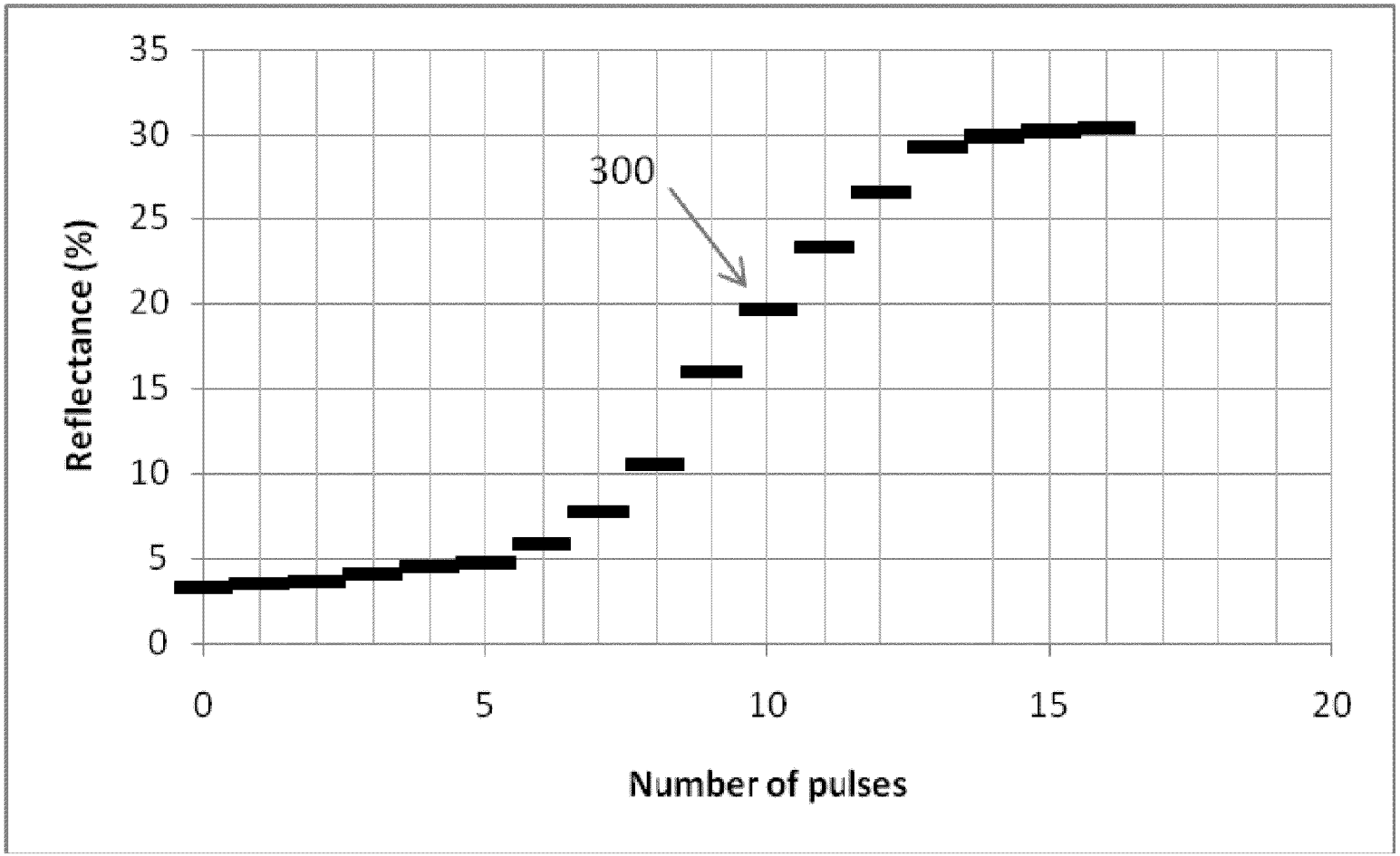
FIG. 3 is an optical response curve of reflectance vs. number of pulses.

A typical active matrix electrophoretic device is driven with 30 msec pulses and approximately 16 pulses or 500 msec are required to achieve full on reflectance at room temperature. Fewer pulses are required for higher temperature and more pulses are required for lower temperature. In FIG. 3, curve 100 of FIG. 1 is re-plotted as curve 300 where reflectance is now quantized. Similar curves could be shown for other temperatures or for variations in material properties.

For the active matrix driving scheme, the voltage pulses are applied one line at a time and the voltage is held on each pixel while the other lines are being addressed through the capacitance of the pixel. Once the desired number of pulses has been applied, the gray level is fixed and stable due to the properties of the electrophoretic media and the voltage can be removed.

In FIG. 4, the data of FIG. 3 is re-plotted for ease of understanding an embodiment. The reflectance data has been normalized so that black state is 0% and white state is 100%. The following discussion will apply regardless of the actual reflectance values.

Using the data from FIG. 4, a best fit to a gamma of 2.2 and 1.8 is shown in FIG. 5 and FIG. 6 respectively. Note that to achieve the desired gamma, there are flat spots in the curve due to the lack of enough pulses between black and white. For example, at grey level 9 under gamma 2.2, the display device needs to show a 32.5% reflectance; but the closest fit is only 26.2%. Not only will this lead to an error in desired reflectance, it also creates fewer total gray level steps between black and white. For example, for gamma 2.2, curve 502 has only 11 distinct gray levels.

In the present disclosure, in an embodiment, during operation of an electrophoretic display, or display driver system, or during operational use of a data processing method, a closest integer pulse number is selected, as shown in FIGS. 5 and 6. Because the pulse numbers selected are not the precise numbers, the same number may be selected for different reflectance levels.

TABLE 1

| Grey level | Desired Reflectance Based on Gamma 2.2 | Closest Pulse Number | True Reflectance | True Grey Level | True Grey Level in 8-bit Format |
|---|---|---|---|---|---|
| 0 | 0.0% | 0 | 0.0% | 0.0 | 0 |
| 1 | 0.3% | 0 | 0.0% | 0.0 | 0 |
| 2 | 1.2% | 1 | 0.6% | 1.5 | 23 |
| 3 | 2.9% | 2 | 1.8% | 2.4 | 39 |
| 4 | 5.5% | 3 | 4.0% | 3.5 | 56 |
| 5 | 8.9% | 4 | 14.3% | 6.2 | 99 |
| 6 | 13.3% | 4 | 14.3% | 6.2 | 99 |
| 7 | 18.7% | 4 | 14.3% | 6.2 | 99 |
| 8 | 25.1% | 5 | 26.2% | 8.2 | 131 |
| 9 | 32.5% | 5 | 26.2% | 8.2 | 131 |

TABLE 1-continued

| Grey level | Desired Reflectance Based on Gamma 2.2 | Closest Pulse Number | True Reflectance | True Grey Level | True Grey Level in 8-bit Format |
|---|---|---|---|---|---|
| 10 | 41.0% | 6 | 39.9% | 9.9 | 158 |
| 11 | 50.5% | 7 | 53.4% | 11.3 | 180 |
| 12 | 61.2% | 7 | 53.4% | 11.3 | 180 |
| 13 | 73.0% | 8 | 73.4% | 13.0 | 209 |
| 14 | 85.9% | 9 | 83.8% | 13.8 | 221 |
| 15 | 100.0% | 15 | 99.3% | 15.0 | 255 |

The second column in Table 1 is the desired normalized reflectance value for gamma=2.2 as shown in FIG. 5, curve 500. The "corresponding pulse numbers" are closest integer pulse numbers selected according to FIG. 3 which would produce the desired reflectance levels. The true reflectance is the reflectance of an electrophoretic display corresponding to a particular pulse number chosen and it can be found in FIG. 3.

One embodiment is directed to determining "true grey levels". By determining and using true grey level values, in an embodiment, the present image processing method can generate images which are substantially free of errors caused by the mismatched gamma curve that was chosen. The term "true grey level", in this context, is the grey level of an electrophoretic display determined by an optical response curve, a selected pulse number and a chosen gamma. In other words, the true grey level is the grey level exhibited by an electrophoretic display and defined by a chosen gamma.

A true grey level value corresponding to the true reflectance for each pulse number is generated by the following equation:

$$\text{True Grey Level}=(\text{Total Number of Grey Levels}-1)\times(\text{Normalized True Reflectance})^{1/\gamma}$$

In the example of Table 1, in the equation:

The total number of grey levels minus 1 is 15.

The "normalized true reflectance" is the "true reflectance" normalized to 100%.

The gamma value ($\gamma$) is 2.2.

In the last column of the table, the true grey level is converted to the 8-bit format ($2^8$ or 256 levels) by simple expansion.

Alternatively, the integer pulse numbers may be selected arbitrarily. Table 2 below is an example in which the "corresponding pulse numbers" are pulse numbers between 0 and 20, in ascending order; in this table, the normalized reflectance is used so the values range from 0% to 100%. The order of pulse numbers may be ascending or descending, depending on the waveform used. The numbers selected in this alternative approach may not be the integer pulse numbers which provide the closest reflectance levels. All numerical data in the other columns are calculated following the same approach as shown in Table 1.

TABLE 2

| Grey Level | Reflectance Based on Gamma 2.2 | Corresponding Pulse Number | True Reflectance | True Grey Level | True Grey Level in 8-bit Format |
|---|---|---|---|---|---|
| 0 | 0.0% | 0 | 0.0% | 0.0 | 0 |
| 1 | 0.3% | 4 | 0.2% | 0.8 | 14 |
| 2 | 1.2% | 5 | 0.5% | 1.3 | 23 |
| 3 | 2.9% | 6 | 0.9% | 1.8 | 30 |
| 4 | 5.5% | 7 | 1.4% | 2.2 | 37 |
| 5 | 8.9% | 8 | 3.2% | 3.1 | 53 |

TABLE 2-continued

| Grey Level | Reflectance Based on Gamma 2.2 | Corresponding Pulse Number | True Reflectance | True Grey Level | True Grey Level in 8-bit Format |
|---|---|---|---|---|---|
| 6 | 13.3% | 9 | 4.8% | 3.8 | 64 |
| 7 | 18.7% | 10 | 5.5% | 4.0 | 68 |
| 8 | 25.7% | 11 | 9.4% | 5.1 | 87 |
| 9 | 32.5% | 12 | 16.5% | 6.6 | 112 |
| 10 | 41.0% | 13 | 26.7% | 8.2 | 140 |
| 11 | 50.6% | 14 | 46.8% | 10.6 | 180 |
| 12 | 61.2% | 15 | 60.2% | 11.9 | 202 |
| 13 | 73.0% | 17 | 73.9% | 13.1 | 222 |
| 14 | 85.9% | 18 | 85.7% | 14.0 | 238 |
| 15 | 100.0% | 20 | 100.0% | 15.0 | 255 |

The true grey levels in the 8-bit format in either Table 1 or Table 2 are then fed into an image processor as the threshold levels for error diffusion.

Error diffusion is a type of halftoning or spatial dithering in which the quantization residual is distributed to neighboring pixels which have not yet been processed. The error diffusion process may be a one dimensional or two dimensional error diffusion process. The one dimensional error diffusion process is the simplest form of the algorithm and scans the image one row at a time and one pixel at a time. The error is then added to the value of the next pixel in the image and the process repeats. The algorithm of the two dimensional error diffusion is exactly like one dimensional error diffusion, except, for example, half the error is added to the next pixel and one quarter of the error is added to the pixel on the next line below and one quarter of the error is added to the pixel on the next line below and one pixel forward.

Floyd-Steinberg dithering is another error diffusion technique commonly used by image manipulation software. The algorithm achieves dithering by diffusing the quantization error of a pixel to its neighboring pixels, according to the distribution:

$$\frac{1}{16}\begin{bmatrix} - & \# & 7 \\ 3 & 5 & 1 \end{bmatrix}$$

where "–" denotes a pixel in the current row which has already been processed (hence diffusing an error to it is not possible), and "#" denotes the pixel currently being processed.

The algorithm scans the image from left to right, top to bottom, quantizing pixel values one by one. Each time the quantization error is transferred to the neighboring pixels, while not affecting the pixels that already have been quantized. Hence, if a number of pixels have been rounded downwards, it becomes more likely that the next pixel is rounded upwards, such that on average, the quantization error is close to zero.

Another method is referred to as "minimized average error," and uses a larger kernel:

$$\frac{1}{48}\begin{bmatrix} - & - & \# & 7 & 5 \\ 3 & 5 & 7 & 5 & 3 \\ 1 & 3 & 5 & 3 & 1 \end{bmatrix}$$

In an embodiment, error diffusion is used to convert a multi-level image into an image of fewer levels that is consistent with the capabilities of the display electronics and the electrophoretic media.

More specifically, in an embodiment it is first determined for each pixel where its image value is situated in the scale of true grey levels. A threshold value closest to the image value of the pixel is then chosen. The error between the image value of the pixel and the closest threshold value is then determined. The error diffusion as described is then used in the process of generating output images of fewer levels of grey, e.g., converting from output image representations having 8 bits ($2^8$ or 256 levels) to 4 bits ($2^4$ or 16 levels).

Example

This example demonstrates how the data generated in Table 1 or Table 2 may be utilized in embodiments.

Input image data into an image processor along with values for true grey levels in the 8-bit format taken from the last column in Table 1. The 8-bit format has 256 grey levels. Table 1 also provides how the true grey levels in the 8 bit format correspond to the grey levels in the 4 bit format. For example, true grey level 0 in the 8 bit format corresponds to grey level 0 in the 4 bit format, and true grey level 23 in the 8 bit format corresponds to grey level 2 in the 4 bit format and so on—23 (3), 39 (4), 56 (5), 99 (6), 99 (7), 99 (7), 131 (8), 131 (9), 158 (10), 180 (11), 180 (12), 209 (13), 221 (14) and 255 (15).

Perform error diffusion. FIG. 7 is an abbreviated example illustrating how the error diffusion is performed. In this example, one type of the two dimensional error diffusion methods is used for illustration purpose. In practice, any of the error diffusion techniques known in the art may be used.

(i) The first diagram in FIG. 7 shows eight pixels of 4×2 configuration. The image data for pixels A-H are 70, 100, 60, 65, 80, 60, 45 and 75 respectively. These data are in the 8 bit format.

(ii) The image value 70 of pixel A is situated between 56 (grey level 4 in the output data) and 99 (grey level 5 in the output data). The image value of 70 is closer to 56 (level 4 in the output data), grey level 4 in the 4 bit format is therefore assigned to pixel A (see the second diagram), and the error would be 70-56=(+)14.

(iii) The error of (+) 14 is then distributed to neighboring pixels, such as pixels B, E and F, resulting in the threshold values of pixels B, E and F being 107, 83.5 and 63.5 respectively.

(iv) Pixel B now has the image value of 107 which is between 99 (7 in the output data) and 131 (8 in the output data). The image value 107 is closer to 99, and therefore pixel B is assigned the grey level 7 in the 4-bit format and the error is calculated as (+) 8. The error of (+) 8 is then distributed to pixels C, F and G.

The process continues throughout all of the pixels.

3. Output the dithered 4 bit (0-15) image data.

In case the data in Table 2 are used, in the first step, the 16 levels inputted would be 0, 14, 23, 30, 37, 53, 64, 68, 87, 112, 140, 180, 202, 222, 238 and 255. The remaining steps are the same.

FIG. 8 is a block diagram of a display driver subsystem that may be used to implement the techniques herein in digital electronic hardware, firmware, or a combination thereof. For example, each of the operational steps or algorithmic operations described above may be implemented using hardware, firmware, or a combination in various embodiments of which FIG. 8 is an example.

A display driver subsystem 800 comprises image processing logic 806, and is coupled using driver 818 to an electrophoretic display 820. In an embodiment, image processing logic 806 comprises error diffusion logic 808 that is coupled to and receives image data values 802 and true grey level values 804. The image data values 802 may be stored in various embodiments in volatile or non-volatile memory such as RAM, ROM, EPROM, EEPROM, or flash memory. In an embodiment, the image data values 802 are transiently stored in local RAM after being received from an external data processor or system.

The optical response curve data 812 may be stored in volatile or non-volatile memory in various embodiments. The data are fed to 814 pulse number selector to generate true reflectance values which in turn, along with a chosen gamma, are used to calculate 804 true grey levels.

The error diffusion logic 808 is configured to process the image data values 802 according to an error diffusion algorithm of the type described above to result in generating and at least transiently storing output data values 810.

Optionally the error diffusion logic 808 is coupled to an optical sensor 816 that is located near the electrophoretic display 820 for the purpose of detecting actual reflectance in proximity to the display. The optical sensor 816 is configured to provide a signal representing a true reflectance level at the display 820 to calculate the true grey levels 804 for use in modifying the operation of the error diffusion logic to produce output data 810 as further described above.

Alternatively, some of the functions described in the example above can be performed outside of the image processing logic block 906 as illustrated in FIG. 9. In this case, the optical response curve and the desired gamma are calculated for each condition and stored in a look up table 912. A selected table is fed to true grey levels 094 in memory for processing by error diffusion logic 908. Data is output as described above. In this case the processing logic is simplified since some of the calculations are done in software.

The images generated by the method and shown by the electrophoretic display have the advantage that they are substantially free of errors when being matched with a chosen gamma curve, and this feature was not possible to achieve with the methods previously used.

All of the mathematical calculations or conversions described herein, in practice, may be performed by hardware, software or a combination of both, built in the display device or a display driver subsystem. For example, the algorithms and operations described herein, including the logical elements of FIG. 8 or 9, may be implemented in one or more application-specific integrated circuits (ASICs), field programmable gate arrays (FPGAs), or a combination thereof. Further, each of the process steps and algorithmic operations described herein may be performed by electronic circuits, digital hardware, firmware, or a combination thereof during operation or driving of an electrophoretic display to improve the quality of data that is displayed in the electrophoretic display in real time as image data is received.

Embodiments reduce the quantization errors and the gamma curve errors of a display device and therefore ensure the display quality without changing the driving hardware.

In the example given above, the 8 bit image data were converted to image data in the 4 bit format. In other embodiments, the inputted data may be at an even higher order such as a 10 or 12 bit format. It is also possible to input 4-bit format data and output dithered 4-bit format data.

In an embodiment, it is also possible to have optical response curve data associated with varying environmental conditions (e.g., temperature such as shown in FIG. 2 or photo-exposure) and the age of the display device, stored or represented in logic inside the display driving hardware. Some sensors and algorithms can be built in to select appropriate optical response curves and consequently pulse numbers. For example, if the temperature has changed, the system will be notified by the temperature sensor and a different optical response curve may be chosen to generate a new pulse number table such as FIG. 3. A new set of true grey levels may then be generated accordingly and fed into an image processor to minimize the gamma curve errors. The image quality can therefore be ensured regardless of the environmental conditions or aging history of the display device.

While certain embodiments have been described herein in connection with adjustment for gamma, the methods described herein can also be used to expand the number of effective gray levels beyond the limitation of an electrophoretic display. Even in these cases, the gamma of the display will be preserved using the methods of the embodiments herein.

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, materials, compositions, processes, process step or steps, to the objective, spirit and scope of the present invention. All such modifications are intended to be within the scope of the claims appended hereto.

What is claimed is:

1. A method of image processing for an electrophoretic display, comprising:

(i) inputting a plurality of image data values and a plurality of true grey level values into an image processor;

(ii) performing error diffusion using the image data values and the true grey level values as input, resulting in creating a plurality of output data values comprising dithered true grey level values;

(iii) outputting the output data values to an electrophoretic display device; and further comprising determining the plurality of true grey level values by (a) selecting an optical response curve; (b) selecting integer pulse numbers; (c) identifying a true reflectance level value for each integer pulse number from the optical response curve; and (d) determining the true grey level values from their corresponding true reflectance level values.

2. The method of claim 1 wherein said true grey levels are pre-calculated.

3. A method of image processing for an electrophoretic display, comprising:

(i) inputting a plurality of image data values and a plurality of true grey level values into an image processor;

(ii) performing error diffusion using the image data values and the true grey level values as input, resulting in creating a plurality of output data values comprising dithered true grey level values;

(iii) outputting the output data values to an electrophoretic display device; and further comprising determining the plurality of true grey level values by (a) selecting integer pulse numbers; (b) capturing a true reflectance level value for each integer pulse number by an optical sensor; and (c) determining the true grey level values from their corresponding true reflectance level values.

4. The method of claim 3, wherein the determining the plurality of true grey level values further includes selecting an optical response curve, prior to step (b).

5. A method of image processing for an electrophoretic display, which method comprises:

(a) selecting an optical response curve;

(b) selecting integer pulse numbers;

(c) identifying true reflectance level for each integer pulse number from the optical response curve;

(d) calculating true grey level for each true reflectance level;

(e) inputting image data and the true grey levels into an image processor;

(f) performing error diffusion; and (g) outputting image data with desired number of grey levels.

6. The method of claim 5 wherein the optical response curve is selected depending on environmental conditions.

7. The method of claim 5 wherein said optical response curve is selected depending on an age of an electrophoretic display.

8. The method of claim 5 wherein in step (b) the integer pulse numbers are selected to correspond to closest reflectance levels of a gamma curve.

9. The method of claim 8 wherein said gamma curve is gamma 1.8 curve.

10. The method of claim 8 wherein said gamma curve is gamma 2.2 curve.

11. The method of claim 5 wherein in step (b) the integer pulse numbers are arbitrarily selected.

12. The method of claim 5 wherein in step (d) the true grey level is calculated as True Grey Level=(Total Number of Grey Levels−1)×(Normalized True Reflectance)$^{1/\gamma}$ wherein $\gamma$ represents a desired reflectance compared to an input level characteristic.

13. The method of claim 5 wherein the error diffusion is performed by a two dimensional error diffusion method.

14. The method of claim 5 wherein the true grey levels in step (e) are in an 8 bit data format and the grey levels in step (g) are in a 4 bit format.

15. A display driver circuit, comprising:

a first memory unit configured to receive and store a plurality of image data;

error diffusion logic coupled to the first memory unit and configured to perform error diffusion using the image data values and true grey level values as input and to generate and store a plurality of output data values comprising dithered grey level values;

a display driver configured to couple to an electrophoretic display and to drive the electrophoretic display using the output data values; and further comprising a second memory unit configured to store optical response curve data, wherein the error diffusion logic is configured to determine the plurality of true grey level values by reading the optical response curve data, selecting integer pulse numbers, identifying a true reflectance level value for each integer pulse number from the optical response curve data, and determining the true grey level values from their corresponding true reflectance level values.

16. A display driver circuit, comprising:

a first memory unit configured to receive and store a plurality of image data;

error diffusion logic coupled to the first memory unit and configured to perform error diffusion using the image data values and true grey level values as input and to generate and store a plurality of output data values comprising dithered grey level values;

a display driver configured to couple to an electrophoretic display and to drive the electrophoretic display using the output data values, wherein the error diffusion logic is configured to couple to an optical sensor, to determine the plurality of true grey level values by selecting integer pulse numbers, to receive a true reflectance level value for each integer pulse number from the optical sensor, and to determine the true grey level values from their corresponding true reflectance level values.

17. A display driver circuit, comprising:

a first memory unit configured to receive and store a plurality of image data;

error diffusion logic coupled to the first memory unit and configured to perform error diffusion using the image data values and true grey level values as input and to generate and store a plurality of output data values comprising dithered grey level values;

a display driver configured to couple to an electrophoretic display and to drive the electrophoretic display using the output data values; and further comprising a second memory unit configured to store optical response curve data, wherein the error diffusion logic is configured to determine the plurality of true grey level values by selecting an optical response curve, to select integer pulse numbers, to receive a true reflectance level value for each integer pulse number by an optical sensor, and to determine the true grey level values from their corresponding true reflectance level values.

18. A data display system, comprising:

an electrophoretic display;

a first memory unit configured to receive and store a plurality of image data;

error diffusion logic coupled to the first memory unit and configured to perform error diffusion using the image data values and true grey level values as input and to generate and store a plurality of output data values comprising dithered grey level values;

a second memory unit coupled to the error diffusion logic and configured to store optical response curve data;

wherein the error diffusion logic is configured to determine the plurality of true grey level values by reading the optical response curve data, selecting integer pulse numbers, identifying a true reflectance level value for each integer pulse number from the optical response curve data, and determining the true grey level values from their corresponding true reflectance level values;

a display driver coupled to the electrophoretic display and configured to drive the electrophoretic display using the output data values.

19. The system of claim 18 wherein the error diffusion logic is configured to couple to an optical sensor, to determine the plurality of true grey level values by selecting integer pulse numbers, to receive a true reflectance level value for each integer pulse number from the optical sensor, and to determine the true grey level values from their corresponding true reflectance level values.

* * * * *